US008393867B2

(12) United States Patent
Chon et al.

(10) Patent No.: US 8,393,867 B2
(45) Date of Patent: Mar. 12, 2013

(54) CHAMBERED AIRFOIL COOLING

(75) Inventors: Young H. Chon, West Hartford, CT (US); Tracy A. Propheter-Hinckley, Manchester, CT (US); Eric L. Couch, Frederick, MD (US)

(73) Assignee: United Technologies Corporation, Hartford, CT (US)

( * ) Notice: Subject to any disclaimer, the term of this patent is extended or adjusted under 35 U.S.C. 154(b) by 975 days.

(21) Appl. No.: 12/058,940

(22) Filed: Mar. 31, 2008

(65) Prior Publication Data

US 2009/0246023 A1 Oct. 1, 2009

(51) Int. Cl.
*F01D 5/18* (2006.01)

(52) U.S. Cl. ..... 416/96 A; 416/1

(58) Field of Classification Search ..... 415/115; 416/96 A, 96 R, 97 R
See application file for complete search history.

(56) References Cited

U.S. PATENT DOCUMENTS

| | | | | |
|---|---|---|---|---|
| 3,574,481 | A * | 4/1971 | Pyne et al. | 416/90 R |
| 3,966,357 | A | 6/1976 | Corsmeier | |
| 4,025,226 | A | 5/1977 | Hovan | |
| 4,040,767 | A | 8/1977 | Dierberger et al. | |
| 4,542,867 | A | 9/1985 | Memmen | |
| 5,145,315 | A * | 9/1992 | North et al. | 415/115 |
| 5,207,556 | A | 5/1993 | Frederick et al. | |
| 5,253,976 | A | 10/1993 | Cunha | |
| 5,667,359 | A | 9/1997 | Huber et al. | |
| 5,711,650 | A | 1/1998 | Tibbott et al. | |
| 5,772,398 | A | 6/1998 | Noiret et al. | |
| 6,142,734 | A | 11/2000 | Lee | |
| 6,193,465 | B1 | 2/2001 | Liotta et al. | |
| 6,382,908 | B1 | 5/2002 | Keith et al. | |
| 6,607,355 | B2 | 8/2003 | Cunha et al. | |
| 6,769,875 | B2 * | 8/2004 | Tiemann | 416/97 R |
| 7,104,756 | B2 | 9/2006 | Harding et al. | |
| 8,043,057 | B1 * | 10/2011 | Liang | 416/97 R |

FOREIGN PATENT DOCUMENTS

| | | |
|---|---|---|
| EP | 1136651 | 9/2001 |
| FR | 2149105 | 3/1973 |
| JP | 06129204 A * | 5/1994 |

OTHER PUBLICATIONS

Extended European Search Report dated Jul. 23, 2009.

* cited by examiner

*Primary Examiner* — Edward Look
*Assistant Examiner* — Liam McDowell
(74) *Attorney, Agent, or Firm* — Carlson, Gaskey & Olds, P.C.

(57) ABSTRACT

An airfoil assembly includes an airfoil with at least one cavity that is in communication with a source of cooling air. A baffle is disposed within that cavity and includes a plurality of openings for directing cooling air against the hot wall. A plurality of dividers extends between the baffle walls and the internal cavity to direct cooling air toward one of a leading edge chamber and a trailing edge chamber.

18 Claims, 6 Drawing Sheets

CHAMBERED AIRFOIL COOLING

BACKGROUND OF THE INVENTION

This disclosure generally relates to an airfoil including an internal cooling chamber and baffle. More particularly, this disclosure relates to an airfoil including chambers for preferentially directing cooling air within the cooling chamber.

An airfoil utilized within a gas turbine engine includes a cooling chamber within which cooling air flows to remove heat from an inner surface of a wall exposed to extreme temperatures. A baffle within the cooling chamber includes a plurality of openings for directing air to impinge directly against the inner surface of the hot wall. The impingement of the cooling air against the hot wall improves cooling efficiencies.

Disadvantageously, cooling air that has impinged against the hot wall is warmed and flows toward an exhaust opening opposite from the inlet. The warmer air mixes with the cooler air causing a non-uniform temperature of the cooling air that results in non-uniform cooling along the airfoil. This can result in higher airfoil temperatures in the airfoil as the distance from the inlet increases. The non-uniform and increasing temperatures can reduce cooling efficiency.

Accordingly, it is desirable to design and develop a cooling air baffle and chamber that increases cooling air efficiency and provides uniform cooling air temperatures along the airfoil.

SUMMARY OF THE INVENTION

An exemplarily airfoil assembly includes an airfoil that has at least one cavity disposed between a baffle and internal walls for preferentially directing cooling air to provide uniform flow cooling along the airfoil.

The exemplarily cavity includes dividers disposed between the baffle and the internal walls of the cavity that direct air to leading and trailing edge chambers to prevent uneven distribution of cooling air from a cooling air inlet to an exhaust outlet. Dividers between the baffle and the cavity walls generate a substantially uniform distribution of cooling air over the airfoil.

These and other features of the present invention can be best understood from the following specification and drawings, the following of which is a brief description.

DETAILED DESCRIPTION OF THE PREFERRED EMBODIMENT

Figure 1:
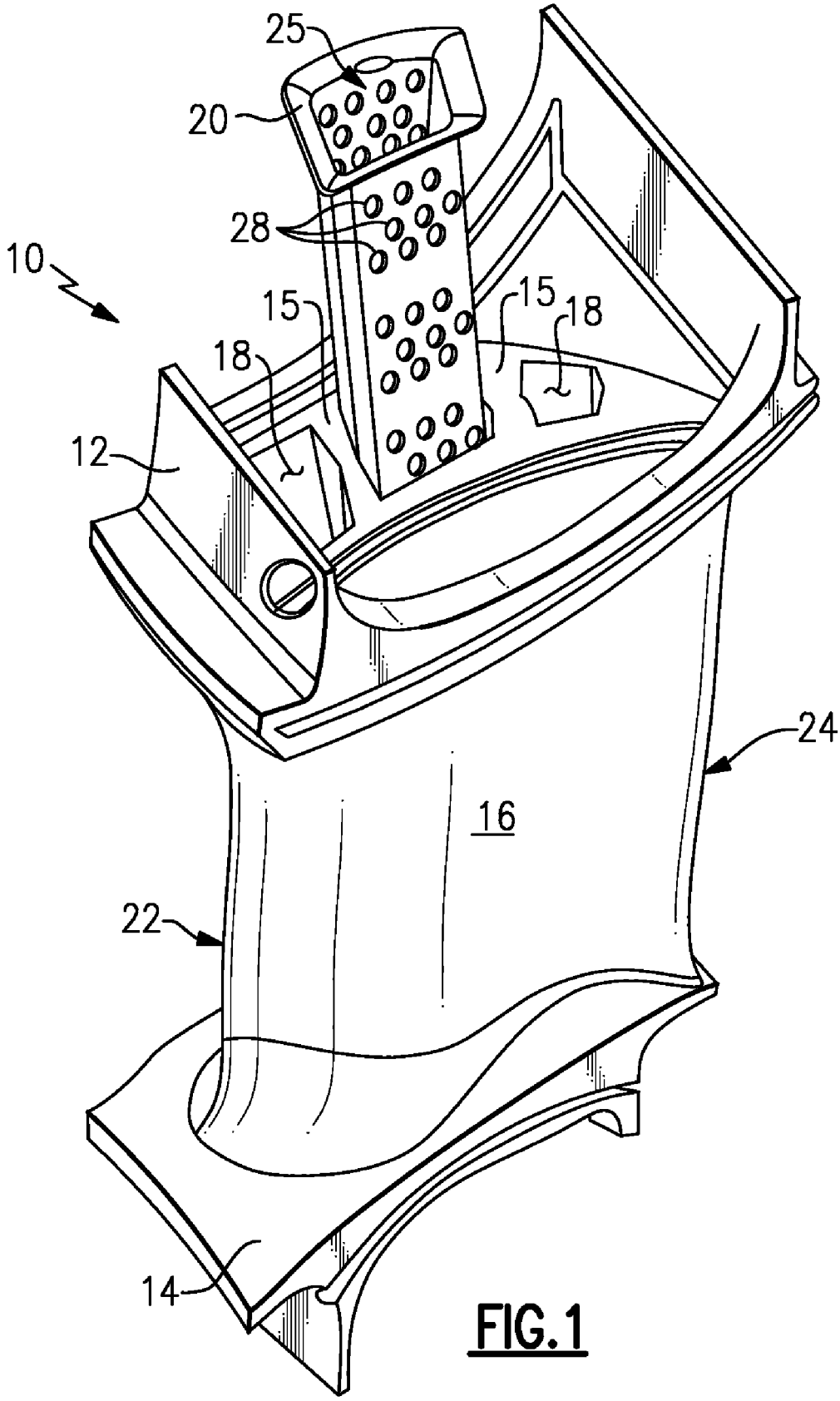
FIG. 1 is a perspective view of an example turbine vane assembly including a baffle within an internal cavity.

Referring to FIG. 1, a turbine vane 10 includes an outer flange 12 and an inner flange 14. Extending between the outer flange 12 and the inner flange 14 is an airfoil 16. The airfoil 16 includes a plurality of cavities 18 separated by ribs 15 through which cooling air is flown. A baffle 20 is inserted into at least one of the cavities 18. The baffle 20 includes a plurality of openings 28 that direct cooling air outwardly against an interior surface, or hot wall of the cavities 18. The airfoil 16 includes a leading edge 22 and a trailing edge 24. The airfoil assembly 16 is exposed to the extreme temperature conditions of hot gas flow emanating from the combustion chamber of the gas turbine engine. Accordingly, the cooling airflow through the cavities 18 provide a cooling function to remove at least some of the heat that is encountered by the airfoil 16.

Figure 2:
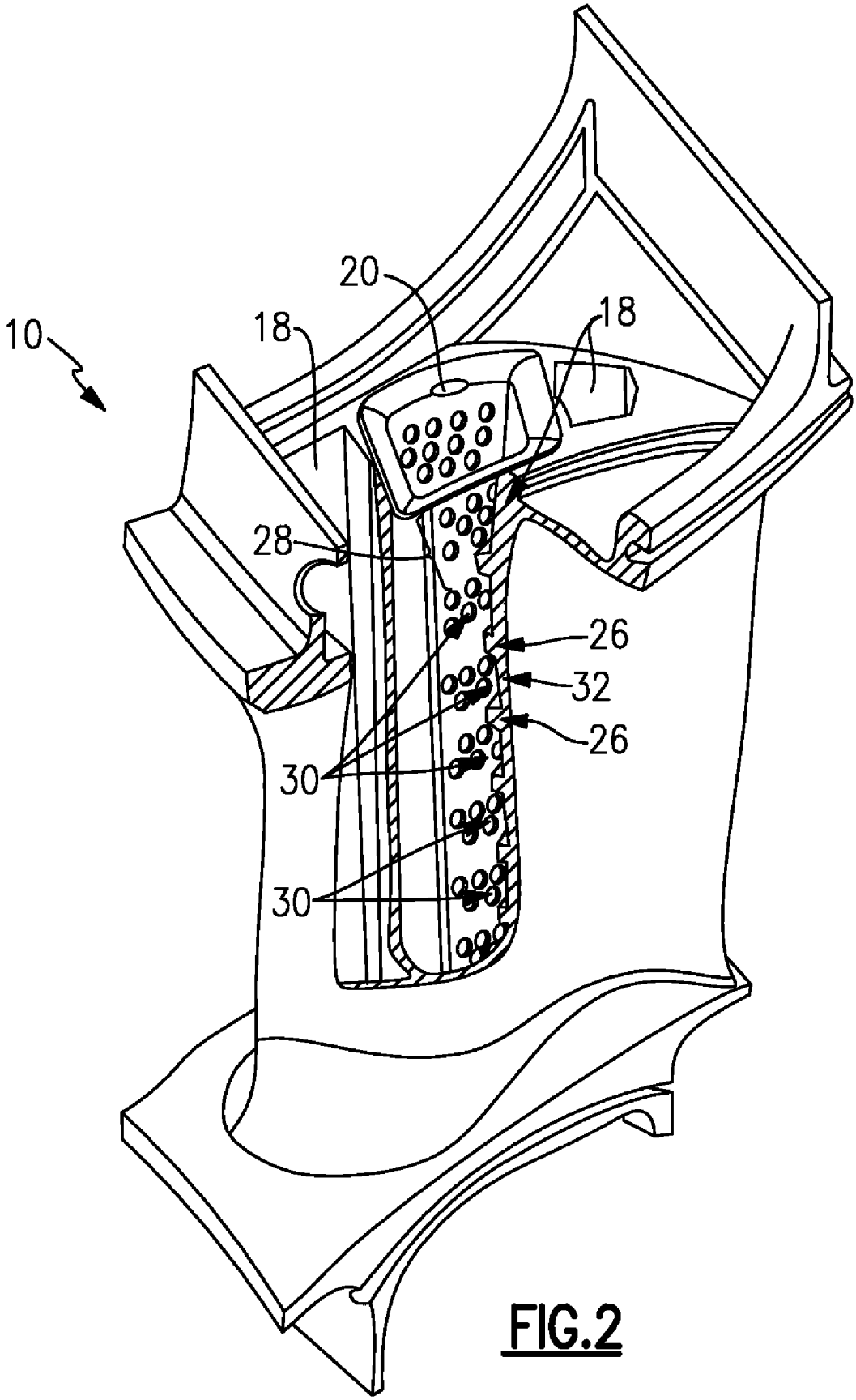
FIG. 2 is a partially sectioned view of the example turbine vane assembly.

Referring to FIG. 2, the turbine vane assembly 10 is shown with one of the cavities 18 cutaway to expose the plurality of openings 28 within the baffle 20. Dividers 26 extend from an interior wall 32 of the cavity 18 and come into direct contact with an exterior wall of the baffle 20. These dividers 26 define chambers 30. The chambers 30 prevent cooling air from flowing downwardly between the internal walls of the cavity 18 and the baffle 20. The dividers 26 prevent cooling air from flowing vertically the length of the airfoil 16 but instead direct air transverse to the direction of impingement towards the leading and trailing edges of the airfoil 16.

Figure 3:
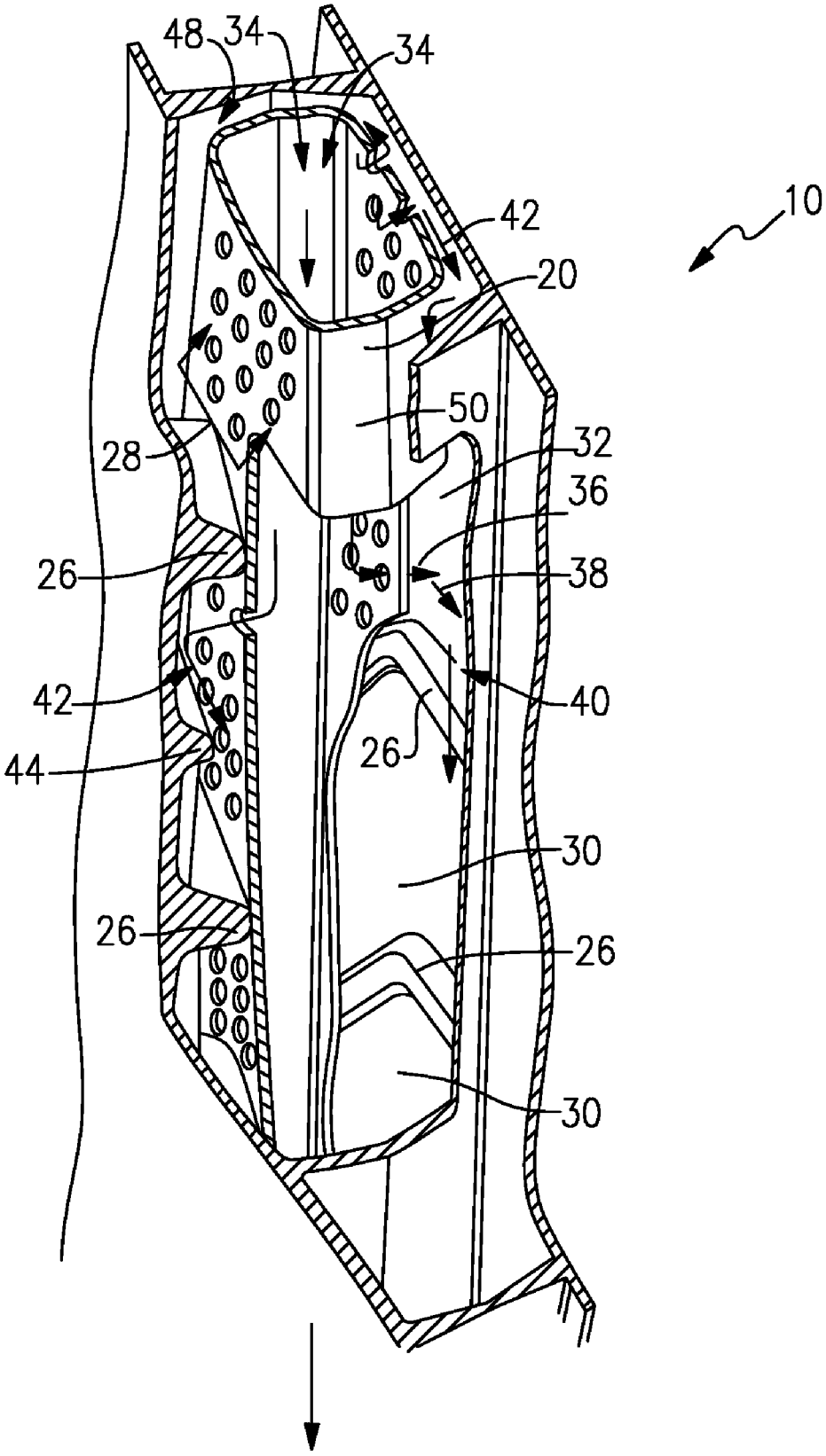
FIG. 3 is another partially sectioned view of the example turbine vane assembly including chambers for directing cooling air flow.

Referring to FIG. 3, the turbine vane assembly 10 illustrates airflow into the baffle 20. Airflow indicated at 34 enters the top portion of the baffle 20 and moves downwardly towards an exhaust outlet of the turbine vane assembly 10. During operation, air enters the opening of the baffle 20 as is indicated by 34 and flows downwardly through the baffle 20. Cooling air exits through one of the pluralities of openings 28 to impinge on the hot interior wall 32 of the cavity 18. Impingement of the cooling air flow 36 on the hot wall 32 provides a reduction in temperature and results in a warming of the cooling air 36.

The cooling air is then directed towards the leading edge and trailing edge of the airfoil 16. The direction or transverse flow direction relative to the impingement flow is indicated at 38 and prevents warmer air from flowing down the airfoil 16.

Each of the dividers 26 defines a substantially horizontal chamber 30 between the baffle 20 and the interior wall 32. The horizontal chambers 30 direct airflow to vertical chambers 48, 50 at the leading and trailing edges of the cavity 18. The vertical chambers 48, 50 allow air to be exhausted out from the cavity 18.

The example dividers 26 are chevron shaped to further direct airflow in a slight downward direction towards vertical chambers 48, 50. Within the chamber 30 are also trip strips 44. The trip strips 44 extend in this example from the interior cavity walls partially into the chamber 30. The trip strips 44 create a turbulent airflow to improve cooling characteristics within each of the chambers 30.

Figure 4:
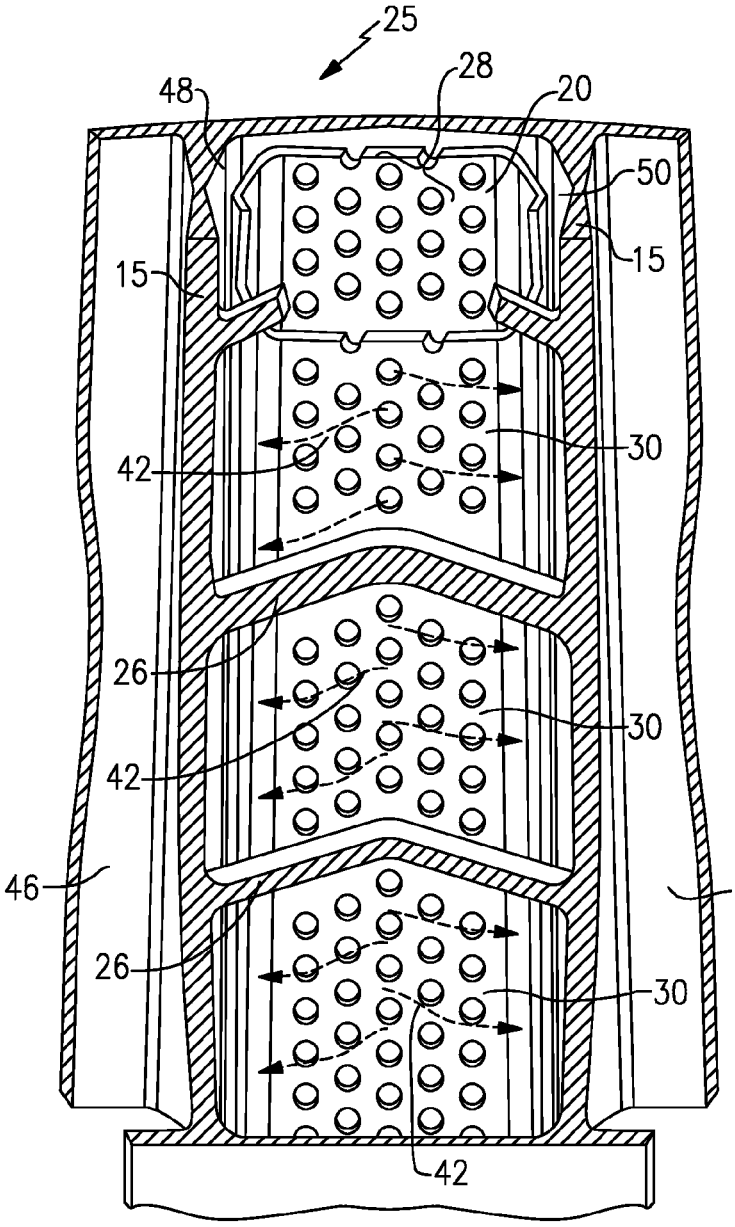
FIG. 4 is a side sectional view of the example turbine vane assembly including transverse airflow chambers.
Figure 5:
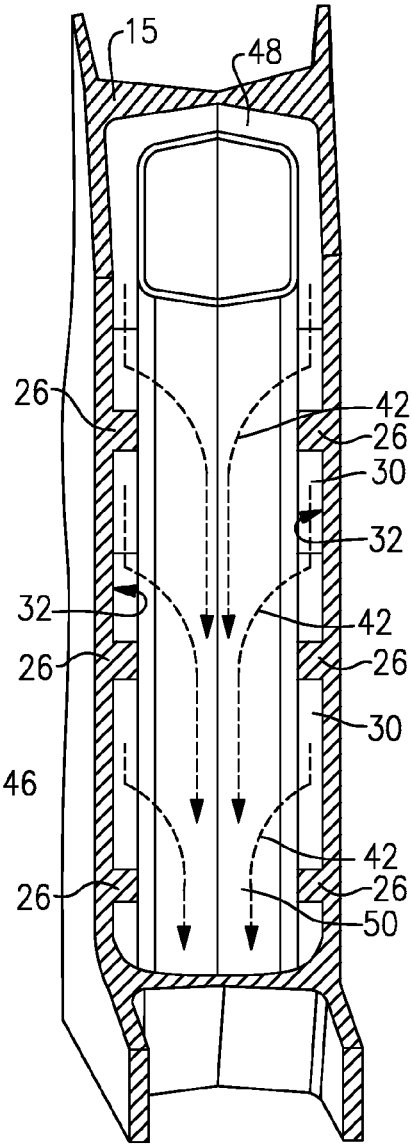
FIG. 5 is a front sectional view of the example turbine vane assembly exposing an example leading edge exhaust chamber.

Referring to FIGS. 4 and 5, the flow of cooling air through the baffle 20 against the hot walls and through the chambers 30 is shown. Airflow enters the inlet opening 25 into the baffle 20. This airflow then exits through one of the plurality of openings 28 to impinge, as indicated at 42 on the hot wall of the cavity 18. The impingement airflow 42 provides cooling on the hot wall of the airfoil 16. Airflow then is directed towards the vertical chambers 48, 50.

The dividers 26 prevent air from moving vertically in the space between the baffle 20 and the hot wall 32. Instead, air is directed towards the vertical chambers 48, 50 such that each chamber 30 receives cooling air that exits through a plurality of openings 28 within the baffle 20. As appreciated, the cooling air within the baffle 20 is cooler than that within the space between the baffle 20 and the interior walls once it has impinged and absorbed heat from the hot wall 32. Accordingly, a chamber 30 that is closest to the entrance 28 includes cooling air at substantially the same temperature as cooling air in a chamber 30 closer to the exhaust opening.

Referring to FIG. 5, the airflow exits the chambers 30 as is indicated at 42 and flows downwardly through the vertical chamber 50. The vertical chamber 48 is disposed at an opposite side of the baffle 20 and also exhausts cooling airflow from the cavity 18.

Figure 7:
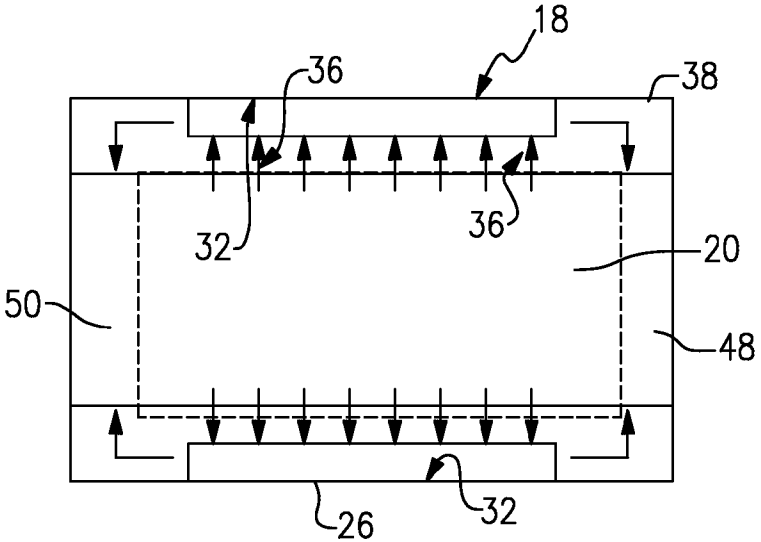
FIG. 7 is a schematic top view of airflow through the example turbine vane assembly.
Figure 6:
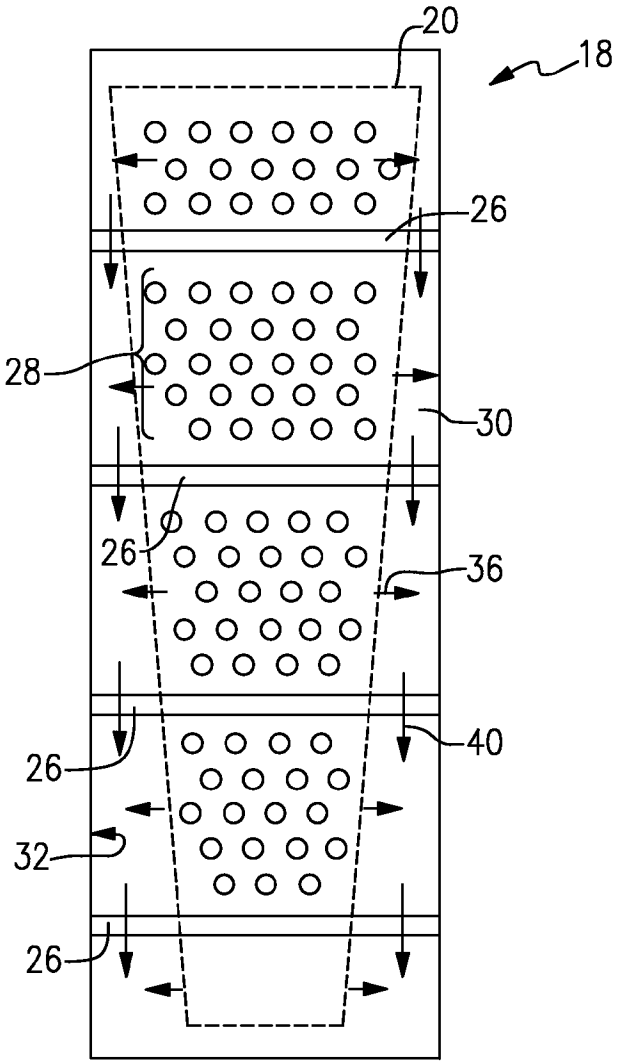
FIG. 6, is a schematic view of airflow through the example turbine vane assembly.

Referring to FIGS. 6 and 7, airflow through the cavity 18 and through the baffle 20 is illustrated schematically. The baffle 20 includes the plurality of openings 28 from which air is expelled to impinge on the hot wall 32. The chambers 30 restrict and direct the flow of air transverse to the flow impingement air and prevent cooling air from flowing vertically downward and warming cooling air further down the airfoil 16. Instead, cooling air is directed transversely towards the vertical chamber 50 or 48.

The ribs used to divide cavities 18 from each other are heated by the warmer cooling air that has absorbed heat from the hot interior wall 32 as air flows into chambers 50 and 48 from chambers 30 and down the airfoil. Thus the air flowing in chambers 50 and 48 helps warm the ribs used to divide cavities 18 from each other thereby reducing the thermal difference between ribs 15 (FIG. 1) dividing cavity 18 and the hot wall 32. Warmed air from chamber 30 exits chamber 30 into chambers 50 and 48 and warms the rib 15 between cavity 18 to at least partially equalize or reduce any thermal difference between the hot wall 32 and the ribs 15 between cavity 18. The reduction in thermal gradients improves durability.

FIG. 7 illustrates impingement of airflow along the hot wall 32 that proceeds transversely from the impingement airflow towards one of the vertical chambers 50, 48. This direction of airflow provides for a substantially uniform cooling airflow temperature to impinge along the entire length of the airfoil 16. As appreciated, each cavity prevents warmer air from moving vertically. This prevents warmed cooling air from above from causing uneven temperature distributions along the length of the air foil 16.

Figure 8:
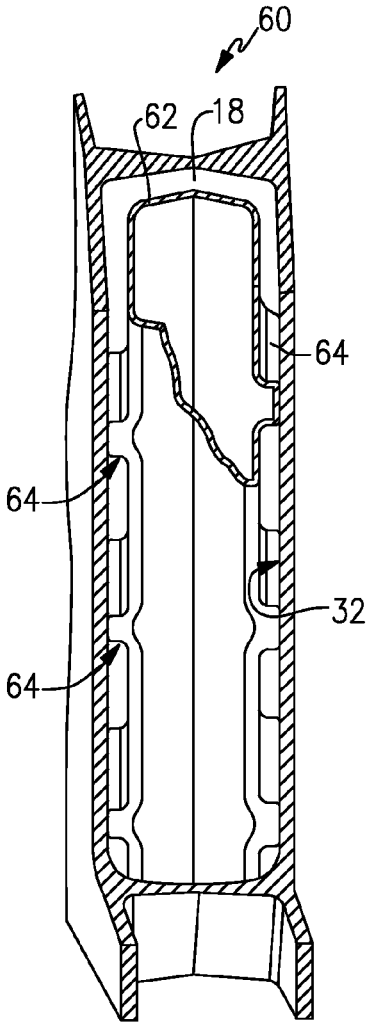
FIG. 8 is another turbine vane assembly including dividers extending as part of the baffle.

Referring to FIG. 8, the example dividers 64 that define the various chambers between baffle 62 and the hot walls 32 can be provided in several different configurations. In the previous example illustrated in FIGS. 6 and 7, the dividers 26 were part of the airfoil 16 and extended from the hot wall 32 inwardly to contact the baffle 62. FIG. 8 illustrates a vane assembly 60 where the baffle 62 includes a plurality of dividers 64 that extends from the baffle 62 towards the hot walls 32 of the cavity 18. The baffle 62 includes the divider 64 that is an integral part of the baffle 62 that extends outwardly.

Figure 9:
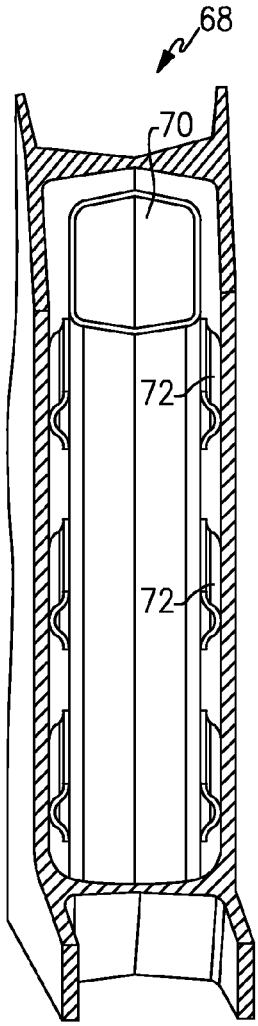
FIG. 9 is another turbine vane assembly including dividers attached to the baffle.

Referring to FIG. 9, another vane assembly 68 includes a baffle 70 with dividers 72 that are secured separately to an exterior surface of the baffle 70. The dividers 72 are welded, or attached to the baffle 70 using known methods. Separate attachment of the dividers 72 provides for the formation of the baffle 70 as a relatively simple cylinder.

Figure 10:
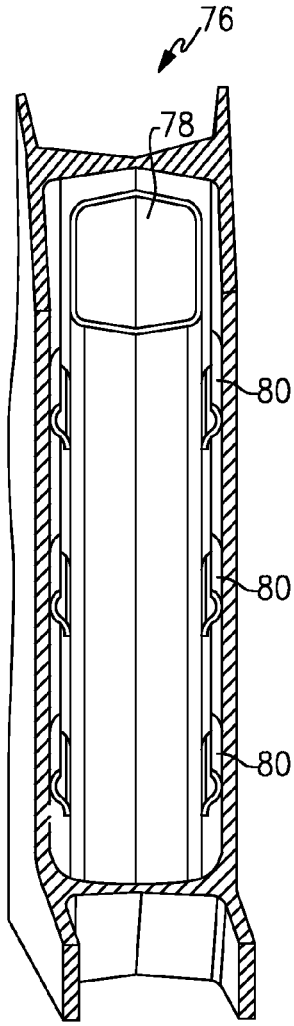
FIG. 10, is another turbine vane assembly including compliant dividers disposed between the baffle and the cavity walls.

Referring to FIG. 10, another vane assembly 76 includes a baffle 78 and a plurality of compliant dividers 80. The plurality of dividers 80 are compliant to accommodate relative expansion and contraction between the baffle 78 and the vane assembly 76. The compliant dividers 80 in this example are attached to the baffles 78; however, other compliant features may be incorporated into other features of the cavity.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An airfoil assembly comprising:

an airfoil defining at least one internal cavity in communication with a source of cooling air;

a baffle disposed within the at least one internal cavity including a plurality of openings for directing cooling air; and a plurality of dividers extending between the baffle and walls of the at least one internal cavity to define a plurality of chambers, wherein each of the plurality of chambers include a first open end opening to a leading edge chamber and a second open end opening to a trailing edge chamber and the plurality of openings include at least some openings into each of the plurality of chambers between the leading edge chamber and the trailing edge chamber.

2. The assembly as recited in claim 1, wherein the plurality of open ended chambers direct airflow transverse to impingement airflow expelled from the plurality of openings within the baffle.

3. The assembly as recited in claim 1, wherein the leading edge chamber and the trailing edge chamber extend an entire length of the internal cavity.

4. The assembly as recited in claim 1, wherein the plurality of dividers are part of the walls of the internal cavity and extend inwardly into direct contact with the baffle.

5. The assembly as recited in claim 1, including mixing members extending from one of the baffle and the wall of the internal cavity partially into at least one of the plurality of chambers to generate turbulent cooling airflow.

6. The assembly as recited in claim 1, wherein each of the plurality of dividers includes a chevron shape including ends that are angled toward an exhaust opening.

7. The assembly as recited in claim 1, wherein the plurality of dividers are part of the baffle and extend outwardly from the baffle into direct contact with the walls of the internal cavity.

8. The assembly as recited in claim 1, wherein the plurality of dividers are compliant to exert a biasing force against both the baffle and the walls of the internal cavity.

9. A method of cooling a turbine airfoil assembly comprising the steps of:

a) communicating a cool air flow into an inlet opening of a baffle disposed within an internal cavity of an airfoil;

b) directing air out of a plurality of openings of the baffle to impinge upon a hot wall of the airfoil, wherein the plurality of openings includes at least some openings for directing air to impinge on a portion of the hot wall of the airfoil between a leading edge and a trailing edge of the airfoil;

c) directing cooling air after impingement on the hot wall of the airfoil, transversely with a plurality of dividers defining a corresponding plurality of chambers between the baffle and the hot walls of the airfoil, wherein each of the plurality of chambers include a first open end opening to a leading edge chamber and a second open end opening to a trailing edge chamber; and d) warming the dividers with the transverse flow of air to reduce a difference in temperature between the plurality of dividers and the hot wall.

10. The method as recited in claim 9, including the step of directing cooling air transversely toward an exhaust chamber extending a length of the airfoil.

11. The method as recited in claim 10, wherein the exhaust chamber is disposed at a leading edge portion of the internal cavity and another chamber is disposed at a trailing edge portion of the internal cavity.

12. The method as recited in claim 9, including the step of generating turbulent flow within at least one of the plurality of chambers with a trip strip that extends partially into the space between the baffle and the hot walls of the internal cavity.

13. The method as recited in claim 9, including the step of forming the plurality of dividers in the walls of the internal cavity.

14. The method as recited in claim 9, including the step of forming the plurality of dividers in the baffle.

15. The method as recited in claim 9, wherein the plurality of dividers are compliant to accommodate relative thermal expansion between the baffle and the airfoil.

16. An airfoil assembly comprising:

an airfoil defining at least one internal cavity in communication with a source of cooling air;

a baffle disposed within the at least one internal cavity including a plurality of openings for directing cooling air; and a plurality of dividers extending between the baffle and walls of the at least one internal cavity to define a plurality of chambers transverse to the flow of cooling air into the baffle, each of the chambers including a first opening open to a leading edge chamber and a second opening open to a trailing edge chamber, wherein the plurality of openings include at least some openings into each of the plurality of chambers transverse to the flow of cooling air into the baffle and each of the plurality of dividers are compliant to accommodate relative thermal expansion between the baffle and the airfoil.

17. The airfoil assembly as recited in claim 16, wherein the baffle comprise a cylinder to which the plurality of dividers are attached.

18. The airfoil assembly as recited in claim 16, wherein each of the plurality of dividers is chevron shaped with a tapered portion extending away from a center of the baffle for directing airflow towards one of the leading edge chamber and the trailing edge chamber.

* * * * *